US012618187B2

(12) United States Patent
Kandasamy et al.

(10) Patent No.: US 12,618,187 B2
(45) Date of Patent: May 5, 2026

(54) RESTRICTOR RING FOR AN AGITATOR OF A WASHING MACHINE APPLIANCE

(71) Applicant: Haier US Appliance Solutions, Inc., Wilmington, DE (US)

(72) Inventors: Senthil Kandasamy, Louisville, KY (US); Troy Marshall Wright, Louisville, KY (US); Isaiah Littlejohn, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 252 days.

(21) Appl. No.: 18/447,188

(22) Filed: Aug. 9, 2023

(65) Prior Publication Data

US 2025/0051992 A1 Feb. 13, 2025

(51) Int. Cl.

| | |
|---|---|
| ***D06F 39/02*** | (2006.01) |
| *D06F 1/04* | (2006.01) |
| *D06F 13/02* | (2006.01) |

(52) U.S. Cl.

CPC ..... *D06F 39/024* (2013.01); *D06F 1/04* (2013.01); *D06F 13/02* (2013.01)

(58) Field of Classification Search

CPC ..... D06F 39/024

See application file for complete search history.

(56) References Cited

U.S. PATENT DOCUMENTS

| | | | | |
|---|---|---|---|---|
| 3,085,417 | A * | 4/1963 | Oles | D06F 37/145 68/17 A |
| 3,466,900 | A | 9/1969 | Elliott, Jr. | |
| 3,620,054 | A * | 11/1971 | Manthei | D06F 39/024 68/27 |
| 4,118,957 | A * | 10/1978 | Marcussen | D06F 39/024 68/17 A |
| 4,186,574 | A | 2/1980 | Sundstrom | |
| 4,240,277 | A * | 12/1980 | Manthei | D06F 39/024 68/17 A |
| 5,113,542 | A | 5/1992 | Pastryk et al. | |
| 11,155,951 | B2 | 10/2021 | Li et al. | |
| 2004/0016267 | A1* | 1/2004 | Clark | D06F 13/02 68/133 |

FOREIGN PATENT DOCUMENTS

| | | | |
|---|---|---|---|
| GB | 589374 | A | 6/1947 |
| WO | WO2022173224 | A1 | 8/2022 |

* cited by examiner

*Primary Examiner* — Michael E Barr
*Assistant Examiner* — Kevin G Lee
(74) *Attorney, Agent, or Firm* — Dority & Manning, P.A.

(57) ABSTRACT

An agitator for a washing machine appliance may define an axial direction and a radial direction. The agitator may include a cylindrical shaft that may include one or more dispense ports defined therethrough. The agitator may further include a cap assembly positioned at a top portion of the agitator. The agitator may additionally include a restrictor ring positioned within the agitator below the cap assembly. The restrictor ring may include a frustoconical wall, a first cylindrical wall, a second cylindrical wall, and a trough. The frustoconical wall may include a top surface and a bottom surface. The trough may be defined at the bottom surface of the frustoconical wall.

20 Claims, 8 Drawing Sheets

RESTRICTOR RING FOR AN AGITATOR OF A WASHING MACHINE APPLIANCE

FIELD

The present subject matter relates generally to a washing machine appliance, and more particularly to a restrictor ring for an agitator of a washing machine appliance.

BACKGROUND

Washing machine appliances generally include a wash tub for containing water or wash fluid (e.g., water, detergent, bleach, fabric softener, or other wash additives). A basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element can rotate at various speeds to agitate articles within the wash chamber, to wring wash fluid from articles within the wash chamber, etc.

Conventional washing machine appliances may include a fluid receptacle for receiving a wash substance, such as a fabric softener solution. Users may pour the wash substance into the fluid receptacle and the washing machine appliance is configured to dispense the fluid at a desired portion of the wash cycle. However, leakage of the wash substance may occur during or after the desired portion of the wash cycle. Such leakage may expose the wash basket to the wash substance at unwanted times which may lead to rust, degradation, or deterioration of the wash basket.

Accordingly, an improved agitator that mitigates or eliminates the likelihood of wash substance leakage is desired. More specifically, a restrictor ring that may be configured to arrest residual wash substance leakage during operation of the washing machine appliance would be particularly beneficial.

BRIEF DESCRIPTION

Aspects and advantages of the invention will be set forth in part in the following description, or may be apparent from the description, or may be learned through practice of the invention.

In one exemplary embodiment, a washing machine appliance is provided. The washing machine appliance may define a vertical direction, a lateral direction, and a transverse direction. The washing machine appliance may include a cabinet. The washing machine appliance may also include a tub positioned within the cabinet. The washing machine appliance may further include a wash basket rotatably mounted within the tub. The washing machine appliance may also include an agitator disposed in the wash basket to impart an oscillatory motion in the wash basket. The agitator may include a cylindrical shaft. The cylindrical shaft may include one or more dispense ports defined therethrough. The washing machine appliance may include a cap assembly positioned at a top portion of the agitator. The washing machine appliance may also include a restrictor ring positioned within the agitator below the cap assembly. The restrictor ring may include a frustoconical wall, a first cylindrical wall, and a second cylindrical wall. The frustoconical wall may include a top surface a bottom surface. The restrictor ring may define a trough at the bottom surface of the frustoconical wall.

In another exemplary embodiment, an agitator for a washing machine appliance is provided. The agitator may define an axial direction and a radial direction. The agitator may include a cylindrical shaft that may include one or more dispense ports defined therethrough. The agitator may also include a cap assembly positioned at a top portion of the agitator. The agitator may further include a restrictor ring positioned within the agitator below the cap assembly. The restrictor ring may include a frustoconical wall, a first cylindrical wall, and a second cylindrical wall. The frustoconical wall may include a top surface a bottom surface. The restrictor ring may define a trough at the bottom surface of the frustoconical wall.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
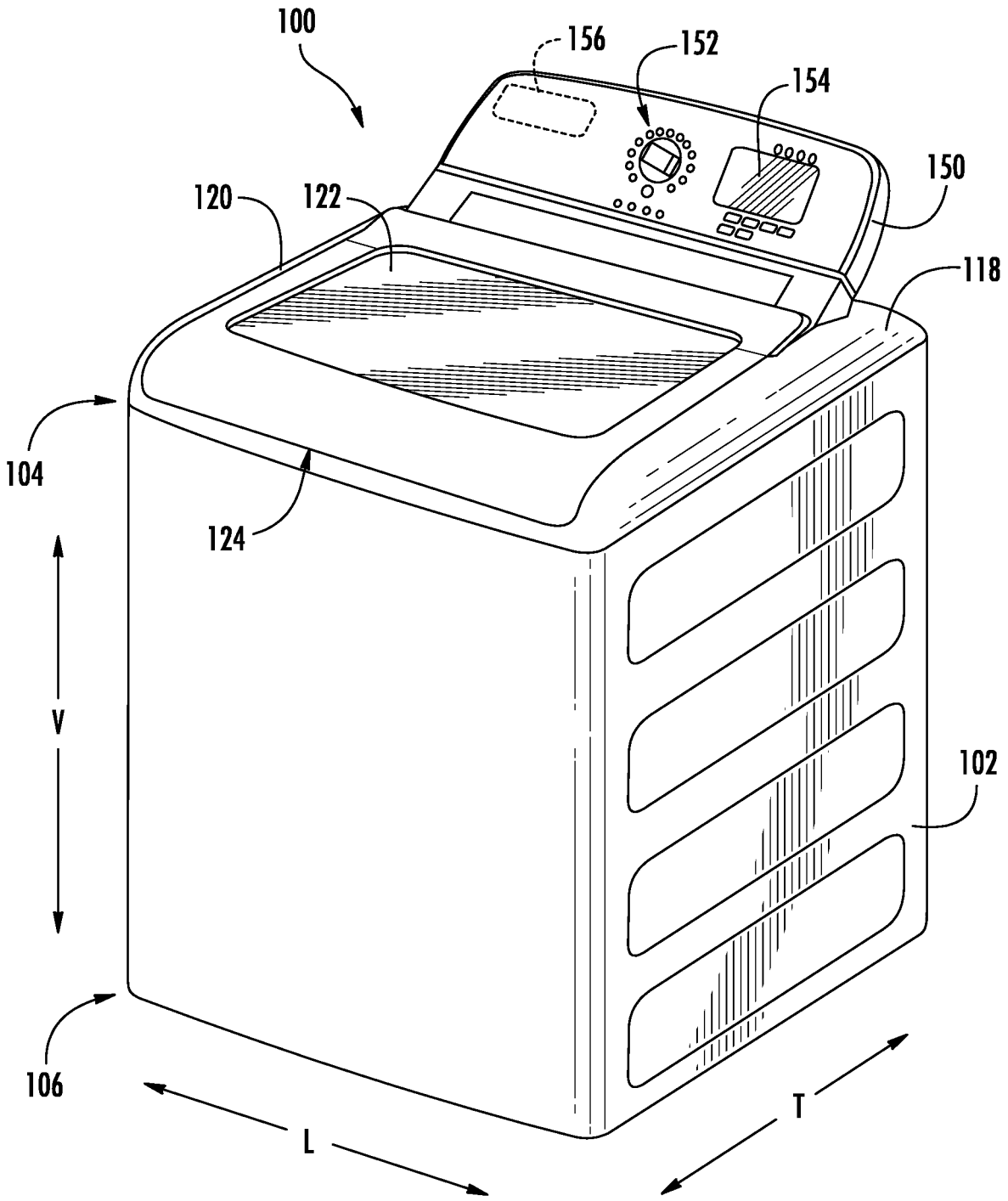
FIG. 1 provides a perspective view of a washing machine appliance with a door in a closed position according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

The terms "wash fluid" and the like may be used herein to generally refer to a liquid used for washing and/or rinsing clothing or other articles. For example, the wash fluid is typically made up of water that may include other additives such as detergent, fabric softener, bleach, or other suitable treatments (including combinations thereof).

Figure 2:
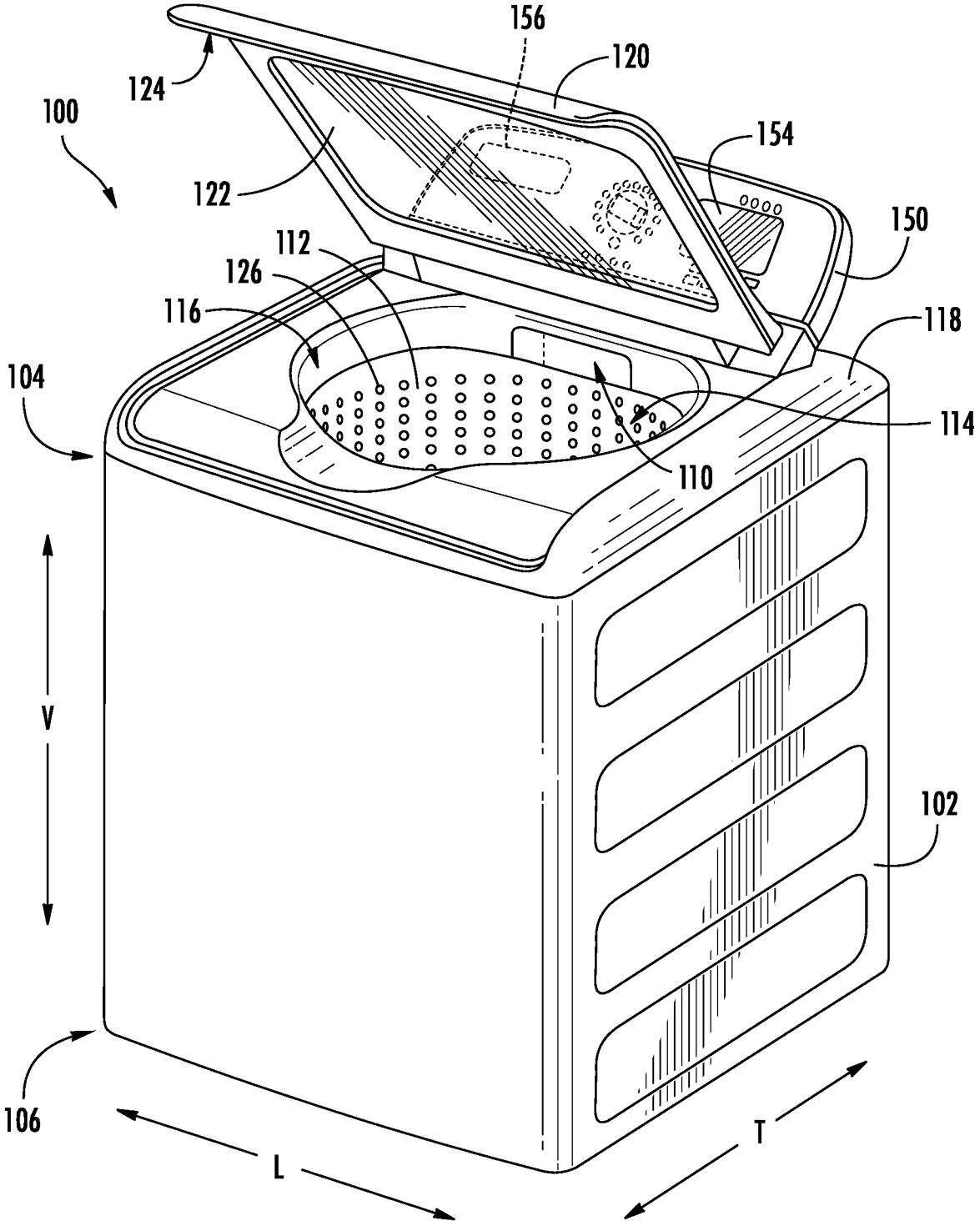
FIG. 2 provides a perspective view of the exemplary washing machine appliance of FIG. 1 with the door in an open position.
Figure 3:
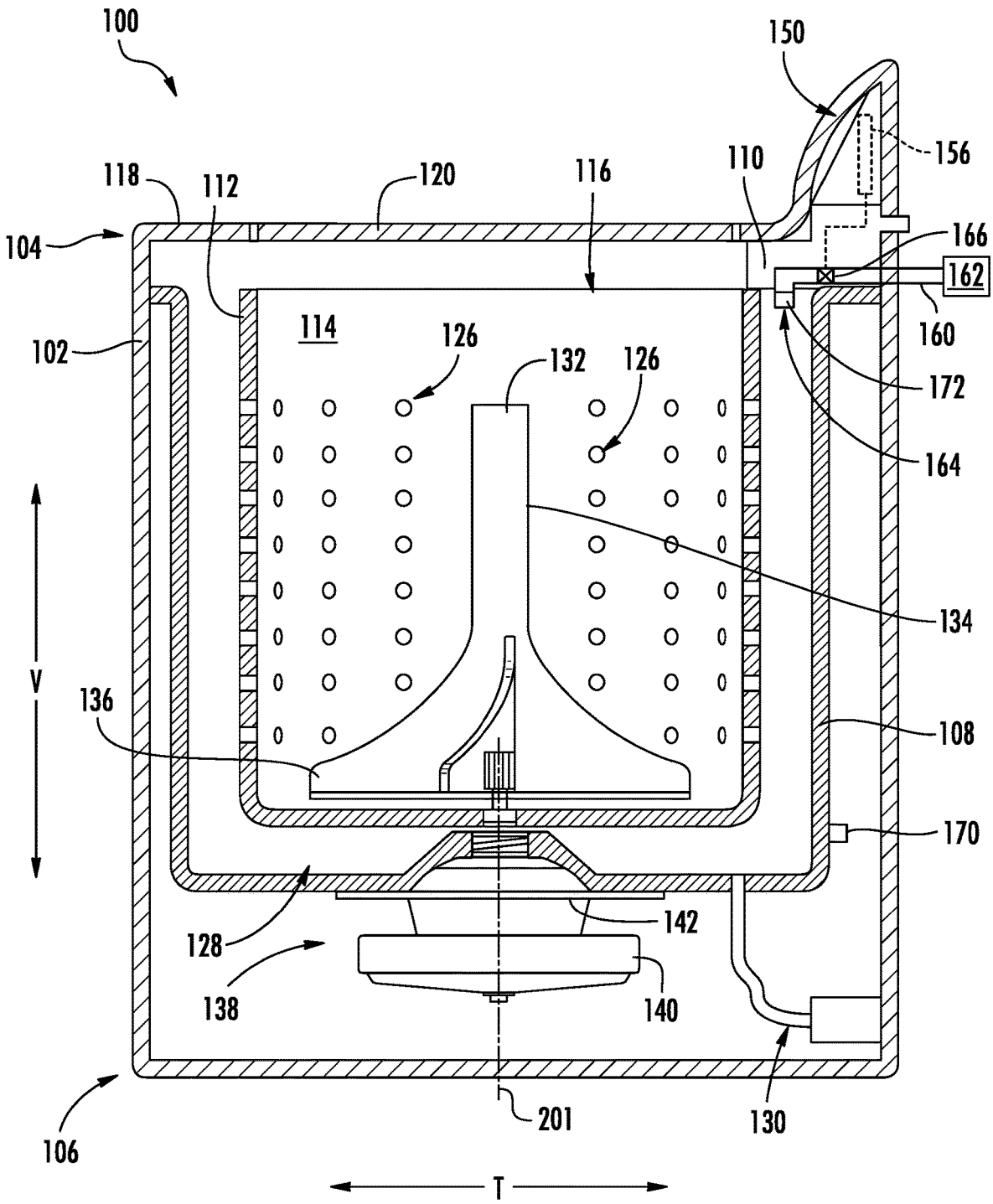
FIG. 3 provides a cut-away side view of the exemplary washing machine appliance of FIG. 1.

FIGS. 1 through 3 illustrate an exemplary embodiment of a washing machine appliance 100. Specifically, FIGS. 1 and 2 illustrate perspective views of washing machine appliance 100 including a door 12 in a closed position and an open position, respectively. FIG. 3 provides a side cross-sectional view of washing machine appliance 100. Washing machine appliance 100 may generally define a vertical direction V, a lateral direction L, and a transverse direction T, each of which is mutually perpendicular, such that an orthogonal coordinate system may generally defined.

While described in the context of a specific embodiment of a vertical axis washing machine appliance, it should be appreciated that washing machine appliance 100 is provided by way of example only. It will be understood that aspects of the present subject matter may be used in any other suitable washing machine appliance. Indeed, modifications and variations may be made to washing machine appliance 100, including different configurations, different appearances, and/or different features while remaining within the scope of the present subject matter. For instance, washing machine appliance 100 may be a combination washing machine and dryer appliance.

Washing machine appliance 100 may include a cabinet 102 that may extend between a top portion 104 and a bottom portion 106 approximately along the vertical direction V. As best shown in FIG. 3, a tub 108 may be positioned within cabinet 102 and may generally be configured for retaining wash fluids during an operating cycle (e.g., a washing cycle). Washing machine appliance 100 may further include a primary dispenser 110 (FIG. 2) for dispensing wash fluid into tub 108. The term "wash fluid" refers to a liquid used for washing and/or rinsing articles during an operating cycle and may include any combination of water, detergent, fabric softener, bleach, and other wash additives or treatments.

Figure 4:
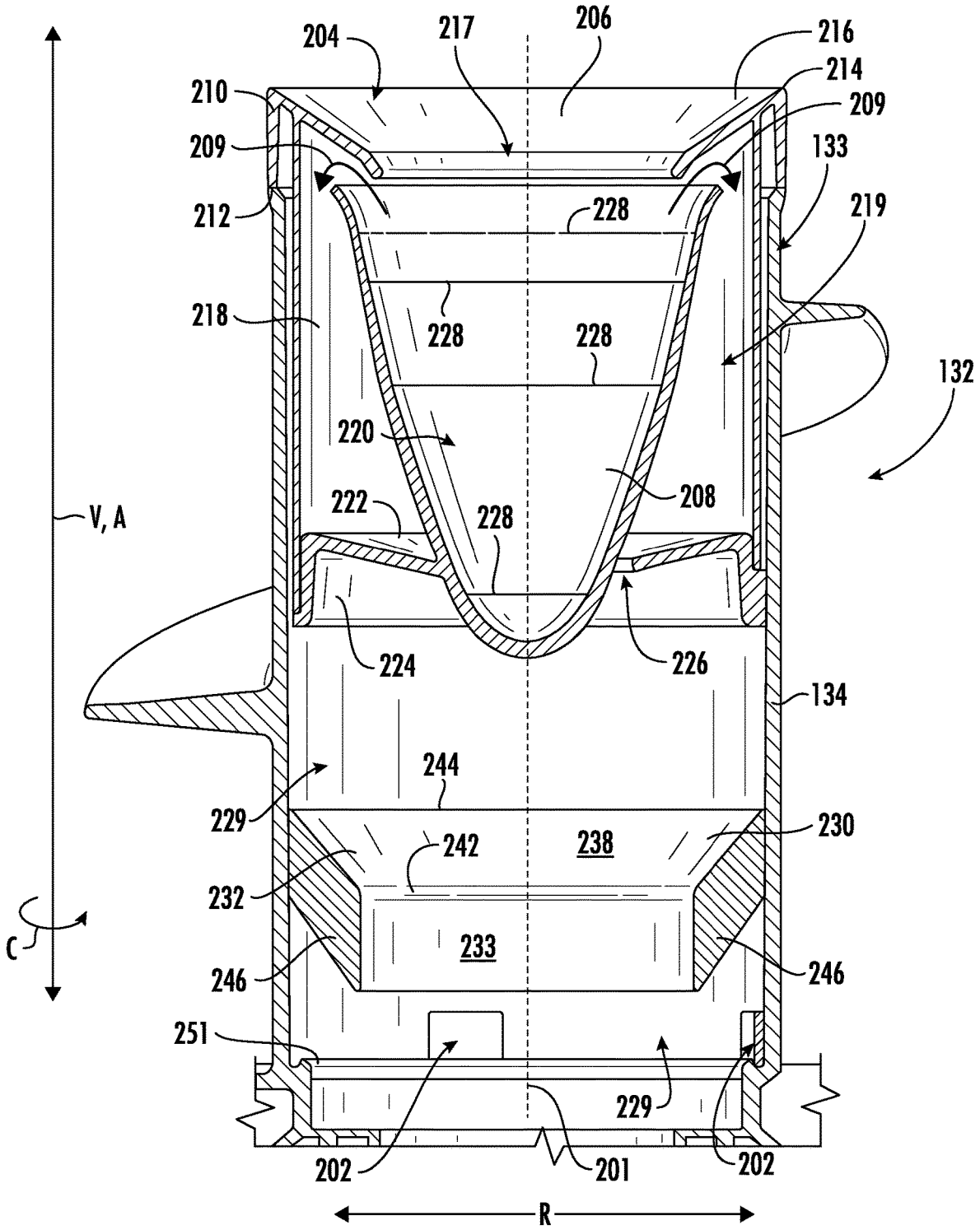
FIG. 4 provides a cross-sectional view of an agitator that may be incorporated into the exemplary washing machine appliance of FIG. 1 according to one or more exemplary embodiments of the present subject matter.

In addition, washing machine appliance 100 may include a drum or wash basket 112 that may be positioned within tub 108 and may generally define a wash chamber 114 that may include an opening 116 for receipt of articles for washing. More specifically, wash basket 112 may be rotatably mounted within tub 108 such that it is rotatable about a central axis 201 (FIG. 4). According to the illustrated embodiment, the central axis 201 may be substantially parallel to the vertical direction V. In this regard, washing machine appliance 100 may generally referred to as a "vertical axis" or "top load" washing machine appliance 100. However, as noted above, it should be appreciated that aspects of the present subject matter may be used within the context of a horizontal axis or front load washing machine appliance as well.

As illustrated, cabinet 102 of washing machine appliance 100 may include a top panel 118. Top panel 118 may define an opening (FIG. 2) that may coincide with opening 116 of wash basket 112 to permit a user access to wash basket 112. Washing machine appliance 100 may further include a door 120 which may be rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 112. Conversely, in the open position, a user may access the wash basket 112. A window 122 in door 120 may permit viewing of wash basket 112 when door 120 may be in the closed position, e.g., during operation of washing machine appliance 100. Door 120 may also include a handle 124 that, e.g., a user may pull and/or lift when opening and closing door 120. Further, although door 120 may be illustrated as mounted to top panel 118, door 120 may alternatively be mounted to cabinet 102 or any other suitable support.

As best shown in FIGS. 2 and 3, wash basket 112 may further define a plurality of perforations 126 to facilitate fluid communication between an interior of wash basket 112 and tub 108. In this regard, wash basket 112 may be spaced apart from tub 108 to define a space for wash fluid to escape wash chamber 114. During a spin cycle, wash fluid within articles of clothing and within wash chamber 114 may be urged through perforations 126 wherein it may collect in a sump 128 defined by tub 108. Washing machine appliance 100 may further include a pump assembly 130 (FIG. 3) that may be located beneath tub 108 and wash basket 112 for gravity assisted flow when draining the tub 108, e.g., after a wash or rinse cycle.

An impeller or agitator 132 (FIG. 3), such as a vane agitator, impeller, auger, oscillatory basket mechanism, or some combination thereof is disposed in wash basket 112 to impart an oscillatory motion to articles and liquid in wash basket 112. More specifically, agitator 132 may include a cylindrical shaft 134 extending along the vertical axis V and an oscillatory member 136 extending from the cylindrical shaft 134. The agitator 132 may extend into wash basket 112 and assists agitation of articles disposed within wash basket 112 during operation of washing machine appliance 100, e.g., to facilitate improved cleaning. In different embodiments, agitator 132 includes a single action element (i.e., oscillatory only), a double action element (oscillatory movement at one end, single direction rotation at the other end)

or a triple action element (oscillatory movement plus single direction rotation at one end, single direction rotation at the other end). As illustrated in FIG. 3, agitator 132 and wash basket 112 are oriented to rotate about central axis 201 (which is substantially parallel to vertical direction V).

As best illustrated in FIG. 3, washing machine appliance 100 may include a drive assembly 138 in mechanical communication with wash basket 112 to selectively rotate wash basket 112 (e.g., during an agitation or a rinse cycle of washing machine appliance 100). In addition, drive assembly 138 may also be in mechanical communication with agitator 132. In this manner, drive assembly 138 may be configured for selectively rotating or oscillating wash basket 112 and/or agitator 132 during various operating cycles of washing machine appliance 100.

More specifically, drive assembly 138 may generally include one or more of a drive motor 140 and a transmission assembly 142, e.g., such as a clutch assembly, for engaging and disengaging wash basket 112 and/or agitator 132. According to the illustrated embodiment, drive motor 140 may be a brushless DC electric motor, e.g., a pancake motor. However, according to alternative embodiments, drive motor 140 may be any other suitable type of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Referring to FIGS. 1 through 3, a control panel 150 with at least one input selector 152 (FIG. 1) may extend from top panel 118. Control panel 150 and input selector 152 may collectively form a user interface input for operator selection of machine cycles and features. A display 154 of control panel 150 may indicate selected features, operation mode, a countdown timer, and/or other items of interest to appliance users regarding operation.

Operation of washing machine appliance 100 may be controlled by a controller 156 that may be communicatively coupled with control panel 150 for user manipulation to select washing machine cycles and features. In response to user manipulation of control panel 150, controller 156 operates the various components of washing machine appliance 100 to execute selected machine cycles and features. Controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication busses.

Referring to FIG. 3, washing machine appliance 100 may include a water supply conduit 160 that provides fluid communication between a water supply source 162 (such as a municipal water supply) and a discharge nozzle 164 for directing a flow of water into tub 108, and more specifically, into wash chamber 114. In addition, washing machine appliance 100 may include a water fill valve or water control valve 166 which may be fluidly coupled with water supply conduit 160 and communicatively coupled to controller 156. In this manner, controller 156 may regulate the operation of water control valve 166 to regulate the amount of water within tub 108. Washing machine appliance 100 may include a flow meter 172. Flow meter 172 may be connected to water supply conduit 160 to measure an amount of water added to tub 108. Flow meter 172 may send the detected water flow amount to controller 156. In addition, washing machine appliance 100 may include one or more pressure sensors 170 for detecting the amount of water and or clothes within tub 108. For example, pressure sensor 170 may be operably coupled to a side of tub 108 for detecting the weight of tub 108. Additionally, or alternatively, pressure sensor 170 may detect and/or calculate a pressure of water within tub 108.

Figure 5:
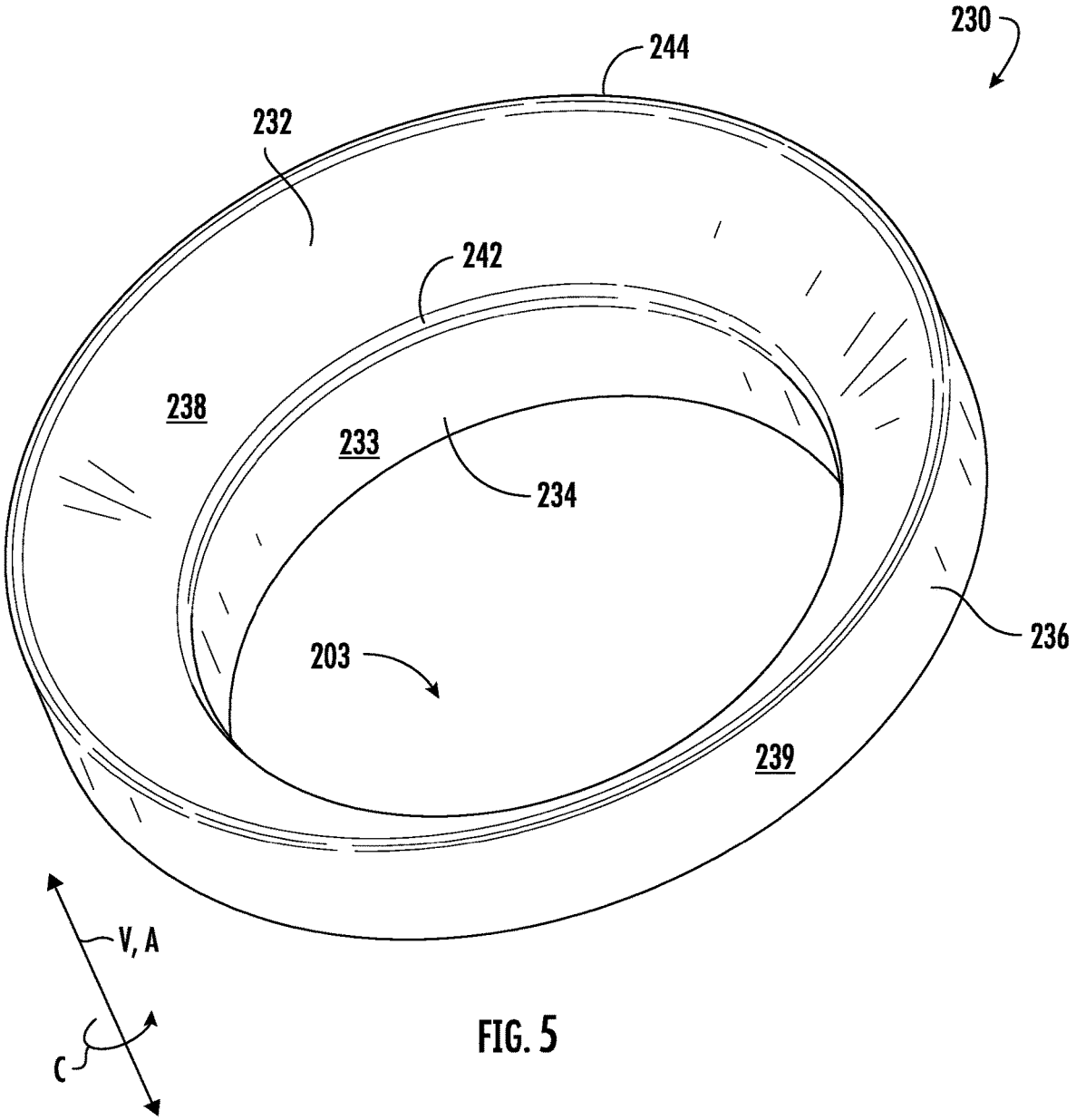
FIG. 5 provides a perspective view of a restrictor ring that may be incorporated into the exemplary agitator of FIG. 4 according to one or more exemplary embodiments of the present subject matter.
Figure 6:
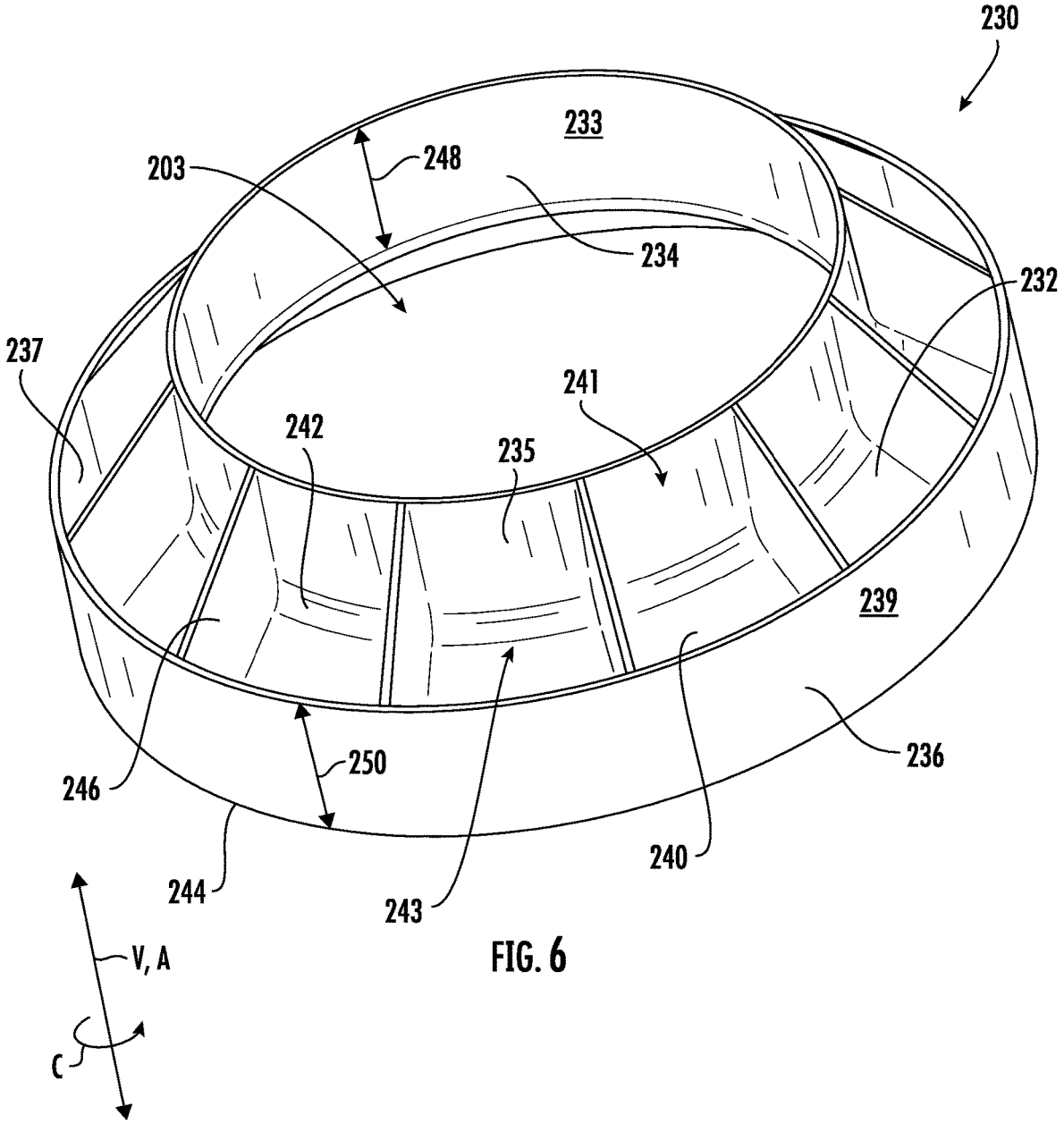
FIG. 6 provides an additional perspective view of the exemplary restrictor ring of FIG. 5.

Referring now to FIGS. 4 through 6, the agitator 132 and a restrictor ring 230 thereof are provided according to one or more exemplary embodiments of the present subject matter. Particularly, FIG. 4 provides a close up cross sectional view of a top portion 133 of the agitator 132 and FIGS. 5 and 6 provide perspective views of the restrictor ring 230 according to one or more exemplary aspects of the present subject matter. In some embodiments, the agitator 132 may define an axial direction A (see also, FIG. 3) approximately along or approximately parallel to a central axis 201, a radial direction R approximately perpendicular to the axial direction A, and a circumferential direction C extending around the axial direction A. As mentioned above, the axial direction A may be approximately parallel to the vertical direction V.

In some embodiments, the cylindrical shaft 134 of the agitator 132 may include one or more dispense ports 202 defined therethrough. The one or more dispense ports 202 may be provided to allow a wash fluid, for instance, fabric softener, to be dispensed into the wash basket 112 during a cycle, for instance a rinse cycle, of the washing machine appliance 100. In addition, in some embodiments, the agitator 132 may include a cap assembly 204 positioned at the top portion 133 of the agitator 132. The cap assembly 204 may include a cap 206 and a fluid receptacle, for instance, a cup 208. In some embodiments, the cap 206 may include a lip 210 that may rest or affix upon the agitator 132. Specifically, the lip 210 may extend approximately along the axial direction A from a first edge 212 that may rest or affix upon the cylindrical shaft 134 of the agitator to a second edge 214.

In some embodiments, the cap 206 may be affixed upon the cylindrical shaft 134 in any suitable manner. For instance, as one non-limiting example, in some embodiments, the first edge 212 of the cap 206 may include a substantially U-shaped (or V-shaped, or other appropriate shape) catchment that may form a groove at which the cylindrical shaft 134 of the agitator 132 may be receivable.

In addition, the cap 206 may include a frustoconical wall 216 that may extend downward approximately along the axial direction A and inward approximately along the radial direction R. In this regard, the frustoconical wall 216 may be tapered toward an opening 217 defined through the cap 206. Further, the cap 206 may include a cylindrical wall 218 that may extend downward approximately along the axial direction A from a bottom side of the frustoconical wall 216. The cylindrical wall 218 of the cap may be inserted within the agitator 132.

In some embodiments, the cup 208 may define a fluid reservoir 220 and may include a base 222 that may be extended outward approximately along the radial direction R from the cup 208 and a skirt 224 that may be extended downward from the base 222 approximately along the axial direction A. Further, in some embodiments, the base 222 of the cup 208 may include one or more apertures 226 defined therethrough. As will be described in more detail below, the apertures 226 may permit a flow of a wash substance, for instance, fabric softener, to flow into a second cavity 229 defined by and between the an inner surface of the cylindrical shaft 134, the cap assembly 204, a bottom wall of the agitator 132 that may include circumferential lip or groove 251.

The cup 208 may be positioned below the opening 217 of the cap 206 to collect a wash substance, for instance, fabric softener, which may be poured through the cap 206 and collected within the fluid reservoir 220 of the cup 208. In some embodiments, for example, as illustrated in FIG. 4, the cup 208 may be attached to the cap 206 via any suitable connection. For instance, as illustrated in FIG. 4, the cylindrical wall 218 of the cap 206 may rest upon or be affixed to a groove that may be defined on an outer surface of the skirt 224. In this regard, the cup 208 may be held within the agitator 132, and more particularly, within the cylindrical wall 218 of the cap 206. Further, in some embodiments, a first cavity 219 may be defined by and between the cylindrical wall 218 of the cap 206 and the cup 208.

In some embodiments, the cup 208 may include one or more fill lines 228 that may be provided to serve as a visual guide, for instance, to a user of the washing machine appliance 100, for proper filling of the fluid reservoir 220 and to help prevent overfilling of the fluid reservoir 220. The fill lines 228 may be marked or designated level lines inside the cup 208 that may indicate the recommended or maximum amount of wash substance, for example, fabric softener, to be filled into the cup 208.

Further, in some embodiments, the second cavity 229 may be formed beneath the cap assembly 204. The agitator 132 may include a restrictor ring 230 positioned within the agitator below the cap assembly 204, for instance, within the second cavity 229. In some embodiments, the restrictor ring 230 may define an opening 203 and include a frustoconical wall 232, a first cylindrical wall 234, and a second cylindrical wall 236. In some embodiments, the frustoconical wall 232 may include a top surface 238, a bottom surface 240, and may define a trough 241 at the bottom surface 240. As will be described in more detail below, the second cylindrical wall 236 may be provided to arrest fluid, for instance, a wash substance such as fabric softener, during a wash cycle of the washing machine appliance 100. In addition, the first cylindrical wall 234 may include an inner surface 233 and an outer surface 235. The second cylindrical wall 236 may include an inner surface 237 and an outer surface 239.

The frustoconical wall 232 may also include a first edge 242 and a second edge 244. In some embodiments, the first cylindrical wall 234 may be extended downward approximately along the axial direction A from the first edge 242 of the frustoconical wall 232 and the second cylindrical wall 236 may be extended downward approximately along the axial direction A from the second edge 244 of the frustoconical wall 232. Further, in some embodiments, the first cylindrical wall 234 may define a first depth 248 and second cylindrical wall 236 may define a second depth 250. In some embodiments, for example, as illustrated in FIGS. 4 through 6, the first depth 248 and the second depth 250 may be approximately the same. As illustrated in FIGS. 4 through 6, the first edge 242 may be an inner edge of the frustoconical wall 232 and the second edge 244 may be an outer edge of the frustoconical wall 232. In this regard, the first cylindrical wall 234 may be a radially inner cylindrical wall and the second cylindrical wall 236 be a radially outer cylindrical wall.

In some embodiments, the restrictor ring 230 may include a plurality of partitions 246 positioned at the bottom surface 240 of the frustoconical wall 232. Each partition 246 may extend from the outer surface 235 of the first cylindrical wall 234 to the inner surface 237 of the second cylindrical wall 236. In this regard, each partition 246 may extend approximately along the radial direction R from the outer surface 235 of the first cylindrical wall 234 to the inner surface 237 of the second cylindrical wall 236. In addition, each partition 246 may extend approximately along the axial direction A from the bottom surface 240 of the frustoconical wall 232 to a bottom edge of the first cylindrical wall 234 and the second cylindrical wall. The plurality of partitions 246 may provide structural support to the restrictor ring 230 and may be spaced apart approximately along the circumferential direction C subdivide the trough 241 into a plurality of pockets 243. In this regard each pocket of the plurality of pockets 243 may be defined between adjacent partitions 246.

Prior to the operation of the washing machine appliance 100, the cap assembly 204 may be provided atop the agitator 132 to receive a wash substance, for instance, fabric softener, within fluid reservoir 220 of the cup 208. For example, a user of the washing machine appliance 100 may flow or pour a wash substance into the fluid reservoir 220 of the cup 208 through the opening 217 defined through the cap 206. In some instances, the user of the washing machine appliance 100 may flow or pour the wash substance into the cup 208 until it may reach the desired fill line 228.

During operation of the washing machine appliance 100, the wash substance that may be collected within the fluid reservoir 220 may be automatically dispensed into the wash basket 112 such that it may mix with a first wash fluid, for instance, liquid water which may also include one or more additional additives other than the wash substance, which may have been flowed into the wash basket 112. The wash substance may thus mix with the first wash fluid to form a second wash fluid, e.g., comprising the mixture of the first wash fluid and the wash substance. For instance, during a portion of a wash cycle of the washing machine appliance 100, the agitator 132 may spin about the central axis 201, e.g., approximately along the circumferential C direction, and may impart a centripetal force upon the wash substance collected within the fluid reservoir 220. This centripetal force may urge or motivate the wash substance, e.g., fabric softener, outward approximately along the radial direction R and upward approximately along the axial direction A. For instance, the centripetal force imparted on the wash substance may urge or motivate the wash substance to the walls of the cup 208 and up the walls of the cup 208, wherein the wash substance may exit the cup 208 through a gap, for example, as generally illustrated by arrows 209. In some embodiments, the gap may be defined between the cup 208 and the frustoconical wall 216 of the cap 206 such that the wash substance may enter the first cavity 219 defined between the cap 206 and the cup 208.

Further, during operation, the rate at which the agitator 132 may spin may be lowered or paused such that the wash substance may collect on the base 222 of the cup and be directed or routed through the apertures 226 defined through the base 222. The wash substance may then fall into the second cavity 229, for example, via the assistance of gravity, wherein the wash substance may be directed or routed into a portion of the second cavity 229 below the restrictor ring 230. For instance, the tapered profile of the frustoconical wall 232 of the restrictor ring 230 may assist in directing and/or routing the falling wash substance through the opening 203 of the restrictor ring 230.

Once the wash substance is below the restrictor ring 230, the rate at which the agitator 132 may spin may be increased to impart a centripetal force on the wash substance. As the centripetal force may urge or motivate the wash substance outward approximately along the radial direction R, some of the wash substance may be dispensed into the wash basket 112 through the dispense ports 202. In some instances, an amount of wash substance may not be dispensed through the dispense ports 202. In such cases, the amount of wash substance not dispensed may be urged upward, for instance, due to the centripetal force acting on the wash substance. The second cylindrical wall 236, and more particularly a seal created, for instance, by an interference fit, between the second cylindrical wall 236 and an inner surface of the cylindrical shaft 134, may be configured to arrest the amount of wash substance not dispensed through the dispense ports 202 and urged upward. As used herein "arrest" (when used as a verb and including cognates thereof such as "arrested") may herein refer to the outer cylindrical wall 236, and more particularly seal between the second cylindrical wall 236 and the inner surface of the cylindrical shaft 134 preventing or restraining the upward movement of the wash substance during operation of the washing machine appliance 100 such that the wash substance is prevented or restrained from entering unwanted areas of the agitator 132, for instance, between the cylindrical wall 218 of the cap 206 and an inner surface of the cylindrical shaft 134 of the agitator 132. This arrest of the wash substance by the second cylindrical wall 236 may prevent leaks of the wash substance and may ensure that the wash substance only enters the wash basket 112 via the dispense ports 202 defined through the agitator 132.

Figure 7:
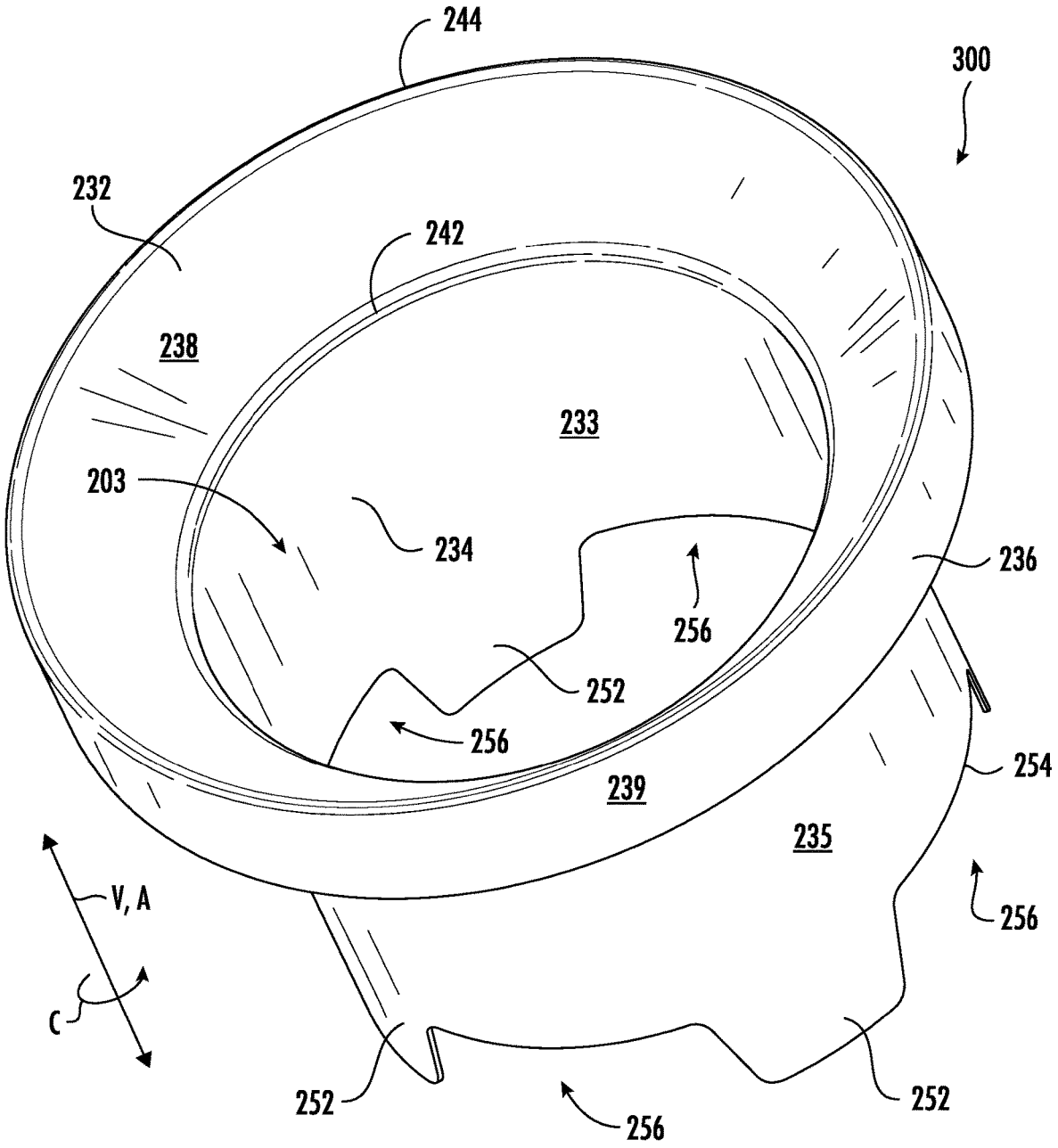
FIG. 7 provides a perspective view of an alternative restrictor ring that may be incorporated into the exemplary agitator of FIG. 4 according to one or more exemplary embodiments of the present subject matter.
Figure 8:
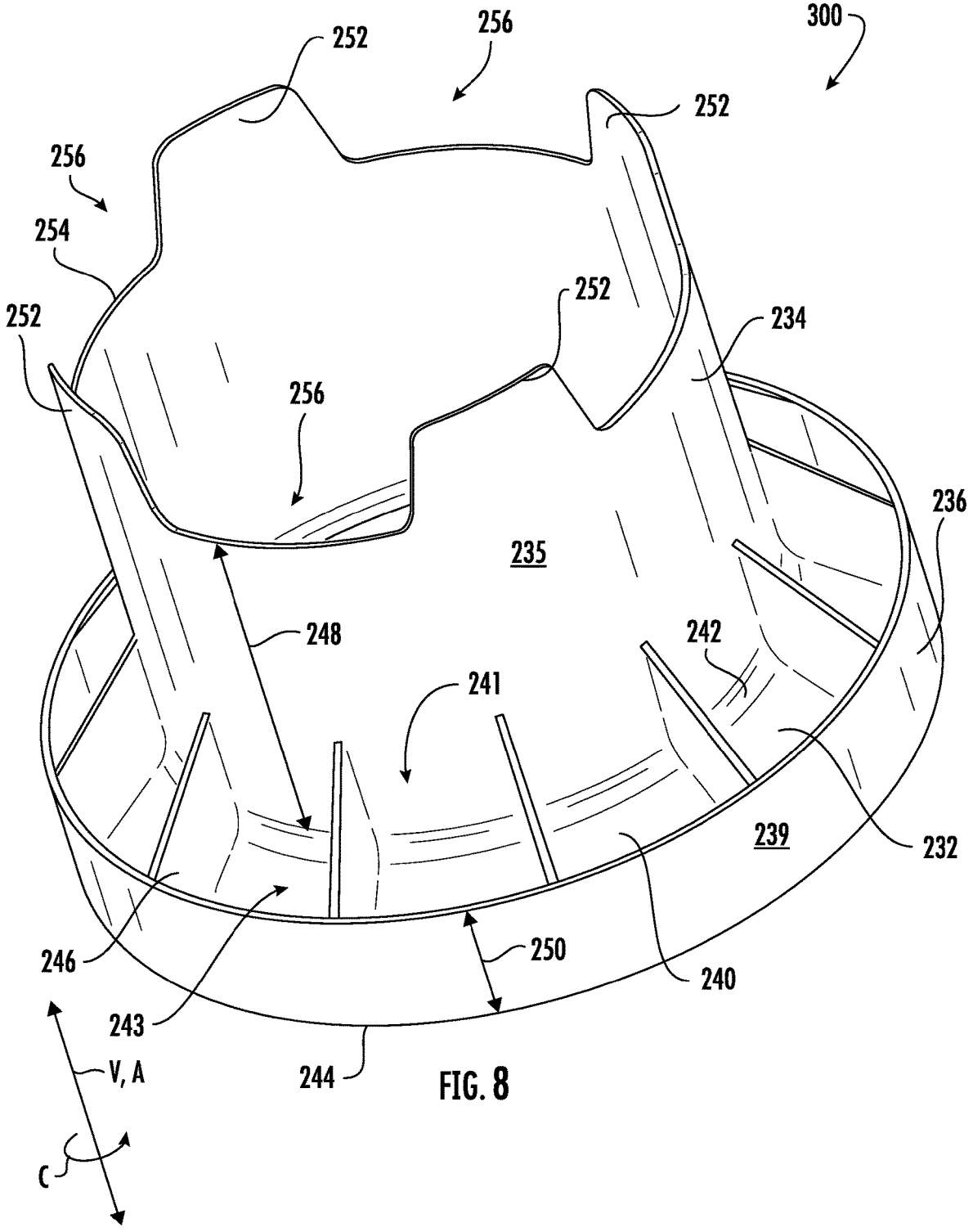
FIG. 8 provides an additional perspective view of the exemplary restrictor ring of FIG. 7.

Referring now to FIGS. 7 and 8, perspective views of a restrictor ring 300 according to one or more exemplary aspects of the present subject matter are provided. The exemplary restrictor ring 300 may be configured in substantially the same manner as the exemplary restrictor ring 230 of FIGS. 4 through 6, and accordingly, the same or similar numbers may refer to the same or similar parts.

For example, the exemplary restrictor ring 300 of FIGS. 7 and 8 generally define an opening 203 and include a frustoconical wall 232, a first cylindrical wall 234, and a second cylindrical wall 236. However, for the embodiment of FIGS. 7 and 8, the first cylindrical wall 234 now includes a plurality of feet 252 that may be provided to locate the restrictor ring 300 within the agitator 132. For example, in some embodiments, the agitator 132 may include a bottom wall that may include circumferential lip or groove 251, see for example, FIG. 4, that the plurality of feet 252 may rest upon such that the restrictor ring 300 may be located within the agitator 132. Specifically, the circumferential lip or groove 251 may extend inward approximately along the radial direction R such that the plurality of feet 252 may have a surface to be positioned on.

In addition, in some embodiments, the first cylindrical wall 234 may extend from the first edge 242 of the frustoconical wall 232 to a bottom edge 254 of the first cylindrical wall 234, wherein the plurality of feet 252 may extend from the bottom edge 254. Further, the plurality of feet 252 may be positioned around a circumference of the first cylindrical wall 234 and may define one or more fluid passages 256. In some embodiments, such as when the restrictor ring 300 positioned within the agitator 132, the one or more fluid passages may generally be aligned with a respective port of the one or more dispense ports 202.

Moreover, for the embodiment of FIGS. 7 and 8, a first depth 248 defined by the first cylindrical wall 234 may be greater than a second depth 250 defined by the second cylindrical wall 236. For example, in some embodiments, the first depth 248 of the first cylindrical wall 234 may be greater than or equal to approximately one and a half times the second depth 250 of the second cylindrical wall 236, for instance, the first depth 248 may be greater than or equal to approximately two times the second depth 250, such as greater than or equal to approximately three times the second depth 250.

Embodiments of the present subject matter advantageously provide a restrictor ring that may arrest residual wash substances, for instance, fabric softener, which may leak after spinning of an agitator during a wash cycle of a washing machine appliance. The restrictor ring may advantageously mitigate or prevent rust that may form in a wash basket of the washing machine appliance due to the leakage of wash substances.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical direction, a lateral direction, and a transverse direction, the washing machine appliance comprising:

a cabinet;

a tub positioned within the cabinet;

a wash basket rotatably mounted within the tub;

an agitator disposed in the wash basket to impart an oscillatory motion in the wash basket, the agitator defining an axial direction approximately parallel to the vertical direction, a radial direction, a circumferential direction extending around the axial direction, the agitator comprising a cylindrical shaft, the cylindrical shaft comprising one or more dispense ports defined therethrough;

a cap assembly positioned at a top portion of the agitator; and a restrictor ring positioned within the cylindrical shaft below the cap assembly, the restrictor ring comprising a frustoconical wall, a first cylindrical wall, and a second cylindrical wall, the frustoconical wall comprising a top surface and a bottom surface, the top surface positioned above the bottom surface approximately along the axial direction, the first cylindrical wall comprising a first surface and a second surface, the first surface of the first cylindrical wall positioned outward of the second surface of the first cylindrical wall approximately along the radial direction, the second cylindrical wall comprising a first surface and a second surface, the first surface of the second cylindrical wall positioned outward of the second surface of the second cylindrical wall approximately along the radial direction, wherein a pocket is defined between the bottom surface of the frustoconical wall, the second surface of the first cylindrical wall, and the first surface of the second cylindrical wall.

2. The washing machine appliance of claim 1, wherein the frustoconical wall comprises a first edge and a second edge, wherein the first cylindrical wall is extended from the first edge, and wherein the second cylindrical wall is extended from the second edge.

3. The washing machine appliance of claim 1, wherein the restrictor ring comprises a plurality of partitions positioned at the bottom surface of the frustoconical wall and a plurality of pockets defined in the pocket between adjacent partitions of the plurality of partitions.

4. The washing machine appliance of claim 1, wherein the first cylindrical wall defines a first depth, wherein the second cylindrical wall defines a second depth, and wherein the first depth and the second depth are approximately the same.

5. The washing machine appliance of claim 1, wherein the first cylindrical wall defines a first depth, wherein the second cylindrical wall defines a second depth, and wherein the first depth is greater than the second depth.

6. The washing machine appliance of claim 1, wherein the first cylindrical wall is extended from a first edge of the frustoconical wall to a bottom edge of the first cylindrical wall, wherein the second cylindrical wall comprises a plurality of feet at the bottom edge, wherein the plurality of feet are spaced around a circumference of the second cylindrical wall and define a plurality of fluid passages.

7. The washing machine appliance of claim 6, wherein each fluid passage of the plurality of fluid passages is aligned with a dispense port of the one or more dispense ports.

8. The washing machine appliance of claim 6, wherein the agitator comprises a circumferential lip within the agitator and wherein the plurality of feet are positioned on the circumferential lip.

9. The washing machine appliance of claim 1, wherein the cap assembly comprises a cap and a cup, wherein the cap is positioned atop the agitator, wherein the cup defines a fluid reservoir and comprises a base and a skirt extended downward from the base, and wherein the base comprises one or more apertures defined therethrough.

10. The washing machine appliance of claim 1, wherein the second cylindrical wall is provided to arrest fluid during a wash cycle of the washing machine appliance.

11. An agitator for a washing machine appliance, the agitator defining an axial direction, a radial direction, and a circumferential direction, the agitator comprising:

a cylindrical shaft comprising one or more dispense ports defined therethrough;

a cap assembly positioned at a top portion of the agitator; and a restrictor ring positioned within the cylindrical shaft below the cap assembly, the restrictor ring comprising a frustoconical wall, a first cylindrical wall, and a second cylindrical wall, the frustoconical wall comprising a top surface and a bottom surface, the top surface positioned above the bottom surface approximately along the axial direction, the first cylindrical wall comprising a first surface and a second surface, the first surface of the first cylindrical wall positioned outward of the second surface of the first cylindrical wall approximately along the radial direction, the second cylindrical wall comprising a first surface and a second surface, the first surface of the second cylindrical wall positioned outward of the second surface of the second cylindrical wall approximately along the radial direction.

12. The agitator of claim 11, wherein the frustoconical wall comprises a first edge and a second edge, wherein the first cylindrical wall is extended downward approximately along the axial direction from the first edge, and wherein the second cylindrical wall is extended downward approximately along the axial direction from the second edge.

13. The agitator of claim 11, wherein the restrictor ring comprises a plurality of partitions positioned at the bottom surface of the frustoconical wall to subdivide a pocket into a plurality of pockets.

14. The agitator of claim 11, wherein the first cylindrical wall defines a first depth, wherein the second cylindrical wall defines a second depth, and wherein the first depth and the second depth are approximately the same.

15. The agitator of claim 11, wherein the first cylindrical wall defines a first depth, wherein the second cylindrical wall defines a second depth, and wherein the first depth is greater than the second depth.

16. The agitator of claim 11, wherein the first cylindrical wall is extended from a first edge of the frustoconical wall to a bottom edge of the first cylindrical wall, wherein the second cylindrical wall comprises a plurality of feet at the bottom edge, wherein the plurality of feet are spaced around a circumference of the second cylindrical wall and define a plurality of fluid passages.

17. The agitator of claim 16, wherein each fluid passage of the plurality of fluid passages is aligned with a dispense port of the one or more dispense ports.

18. The agitator of claim 16, further comprising a circumferential lip within the agitator and wherein the plurality of feet are positioned on the circumferential lip.

19. The agitator of claim 11, wherein the cap assembly comprises a cap and a cup, wherein the cap is positioned atop the agitator, wherein the cup defines a fluid reservoir and comprises a base and a skirt extended downward from the base, and wherein the base comprises one or more apertures defined therethrough.

20. The agitator of claim 11, wherein the second cylindrical wall is provided to arrest a fluid during a wash cycle of the washing machine appliance.

* * * * *